US008020801B2

(12) United States Patent
Eriksson et al.

(10) Patent No.: US 8,020,801 B2
(45) Date of Patent: Sep. 20, 2011

(54) GYRATORY CRUSHER WITH ARRANGEMENT FOR RESTRICTING ROTATION

(75) Inventors: Bengt-Arne Eriksson, Svedala (SE); Johan Gunnarsson, Sövde (SE); Percy Norrman, Höör (SE); Kjell-Åke Svensson, Limhamn (SE)

(73) Assignee: Sandvik Intellectual Property AB, Sandviken (SE)

( * ) Notice: Subject to any disclaimer, the term of this patent is extended or adjusted under 35 U.S.C. 154(b) by 116 days.

(21) Appl. No.: 12/642,324

(22) Filed: Dec. 18, 2009

(65) Prior Publication Data

US 2010/0163660 A1 Jul. 1, 2010

(30) Foreign Application Priority Data

Dec. 19, 2008 (SE) ..... 0802618

(51) Int. Cl.
*B02C 15/10* (2006.01)

(52) U.S. Cl. ..... 241/207; 241/208

(58) Field of Classification Search ..... 241/207–216
See application file for complete search history.

(56) References Cited

U.S. PATENT DOCUMENTS

| | | | | |
|---|---|---|---|---|
| 3,782,647 | A * | 1/1974 | Decker et al. | 241/215 |
| 3,887,143 | A | 6/1975 | Gilbert et al. | |
| 4,016,630 | A * | 4/1977 | Bengtsson et al. | 241/207 |
| 4,060,205 | A * | 11/1977 | Pollak | 241/211 |
| 4,467,971 | A | 8/1984 | Schuman | |
| 4,478,373 | A * | 10/1984 | Gieschen | 241/208 |
| 5,931,394 | A | 8/1999 | Haven et al. | |
| 7,673,821 | B2 * | 3/2010 | Norrman et al. | 241/15 |

OTHER PUBLICATIONS

International Search Report mailed Mar. 17, 2010 issued in PCT Application No. PCT/SE2009/051415.

* cited by examiner

*Primary Examiner* — Faye Francis
(74) *Attorney, Agent, or Firm* — Drinker Biddle & Reath LLP

(57) ABSTRACT

A gyratory crusher has a crushing head on which a first crushing shell is mounted, a frame on which a second crushing shell is mounted, and a driving device, which is arranged with a rotating eccentric to cause the crushing head to execute a gyratory movement for crushing of material. The crushing head is connected to the frame of a rotation-restricting arrangement, which comprises a beater in a tank. Spinning of the crushing head is restricted by the beater being braked, during operation of the crusher, by a liquid contained in the tank.

12 Claims, 4 Drawing Sheets

GYRATORY CRUSHER WITH ARRANGEMENT FOR RESTRICTING ROTATION

CROSS-REFERENCE TO PRIOR APPLICATION

This application claims priority to Swedish Patent Application No. 0802618-9 filed Dec. 19, 2008, which is incorporated by reference herein.

BACKGROUND OF THE INVENTION

1. Technical Field

The present disclosure relates to a device for restricting spinning in a gyratory crusher, which includes a crushing head on which a first crushing shell is mounted; a frame on which a second crushing shell is mounted, wherein the second crushing shell defines, together with the first crushing shell, a crushing gap; and a driving device, which is arranged with a rotating eccentric to cause the crushing head to execute a gyratory movement for crushing material that is introduced in the crushing gap.

2. Background Art

A gyratory crusher of the kind stated above can be used for crushing, for example, ore and rock material into smaller size. A problem associated with gyratory crushers of this kind is that on those occasions when no material is being fed to the crusher, the crushing head will eventually start to rotate with the eccentric, which is generally referred to as spinning. If the crushing head is spinning when feed material is again introduced into the gyratory crusher, there is a risk that material will be ejected from the crusher and/or that the crushing shells will be damaged. Moreover, the wear of bearing mechanisms provided between the eccentric and the crushing head can be considerable.

U.S. Pat. No. 3,887,143 discloses an arrangement for restricting spinning in a gyratory crusher. A hydraulic pump is mounted in the frame bottom part of the crusher with the input drive shaft thereof being connected to the crushing head. The pump is provided with a check valve, which enables it to serve essentially as a hydraulic anti-reverse for the crushing head.

A hydraulic pump provided with an anti-reverse is complex and tends to break relatively easily or become clogged by dirt, which may lead to unwanted shutdowns.

OBJECTS AND SUMMARY OF THE INVENTION

It is desired to provide a gyratory crusher capable of restricting spinning, whereby the above drawbacks associated with the prior art are significantly reduced or completely eliminated.

This can be achieved by a gyratory crusher, which includes a crushing head on which a first crushing shell is mounted; a frame on which a second crushing shell is mounted, wherein the second crushing shell defines, together with the first crushing shell, a crushing gap; and a driving device, which is arranged with a rotating eccentric to cause the crushing head to execute a gyratory movement for crushing material that is introduced in the crushing gap. The crushing head is connected to the frame by way of a rotation-restricting arrangement, which includes a beater arranged to rotate in a tank. The tank is adapted to contain a liquid for braking the rotation of the beater.

An advantage of this gyratory crusher is that a robust and simple anti-spin function is obtained. As a result of the simple design of the above crusher, the number of unwanted shutdowns can be reduced.

According to one embodiment, the eccentric is arranged to rotate about a central shaft and the rotation-restricting arrangement is located inside the central shaft. This positioning results in a particularly compact design of the rotation-restricting arrangement and does not add to the height of the crusher. In a particular embodiment, the center of the beater is located above the center of the central shaft, seen in the vertical direction, this position enabling a relatively simple connection to the crushing head as well as to the central shaft.

According to one embodiment, the tank has a circular-cylindrical wall, which is provided with at least one protrusion extending towards the beater. An advantage of the protrusion is that it increases the braking action exerted by the liquid on the beater and reduces the risk of the liquid swirling round in the tank in an undesirable manner due to the rotation of the beater.

According to one embodiment, the beater includes a beater shaft provided with at least one projecting member, which is to be braked, during rotation of the beater, by a liquid contained in the tank. According to one embodiment, the at least one projecting member can be substantially plate-shaped and can extend from the beater shaft towards the wall of the tank in a plane that is substantially parallel to the extent of the beater shaft. This embodiment is particularly suitable for crushers which can be operated in both directions of rotation.

According to a further embodiment, said at least one projecting member of the beater is of arcuate cross-section, as seen in a plane that is perpendicular to the beater shaft. This shape enables different braking effects to be obtained depending on the direction of rotation of the crushing head, which may reduce the braking action of the rotation-restricting arrangement during rotation of the crushing head in the desired direction of rolling engagement associated with operation.

According to one embodiment, the portion of said at least one projecting member of the beater that is most radially distant from the beater shaft is deflectable, which reduces the risk of damage to the rotation-restricting arrangement when cold starting the crusher, since the viscosity of the liquid can be very high at the time of cold starting.

According to one embodiment, the beater is connected to the crushing head by a universal joint shaft, which is provided with at least one universal joint. In a particular embodiment, the universal joint shaft is divided into an upper shaft section and a lower shaft section, and the shaft sections are rotationally locked together and axially displaceable relative to each other.

In particular embodiments, the rotation-restricting arrangement is adapted to generate, during operation, a braking torque of at least 300 Nm when the crushing head is about to start rotating. In a more particular embodiment, a speed or rotation relative to the frame of the crusher head, when the crushing head is about to start rotating, is 0 revolutions per second.

According to one embodiment, the crushing head is connected to the rotation-restricting arrangement by a torque limiter, which reduces the risk of damage to the rotation-restricting arrangement when cold starting the crusher.

The disclosed makes it possible to provide spinning restriction with fewer mechanical components and/or to improve the operational reliability of said spinning restriction. It is to be understood that both the foregoing general description and the following detailed description are exemplary and explanatory and are intended to provide further explanation, of the invention as claimed.

BRIEF DESCRIPTION OF THE DRAWINGS

The following detailed description can be read in connection with the accompanying drawings in which like numerals designate like elements and in which.

DETAILED DESCRIPTION OF THE PREFERRED EMBODIMENTS

Figure 1:
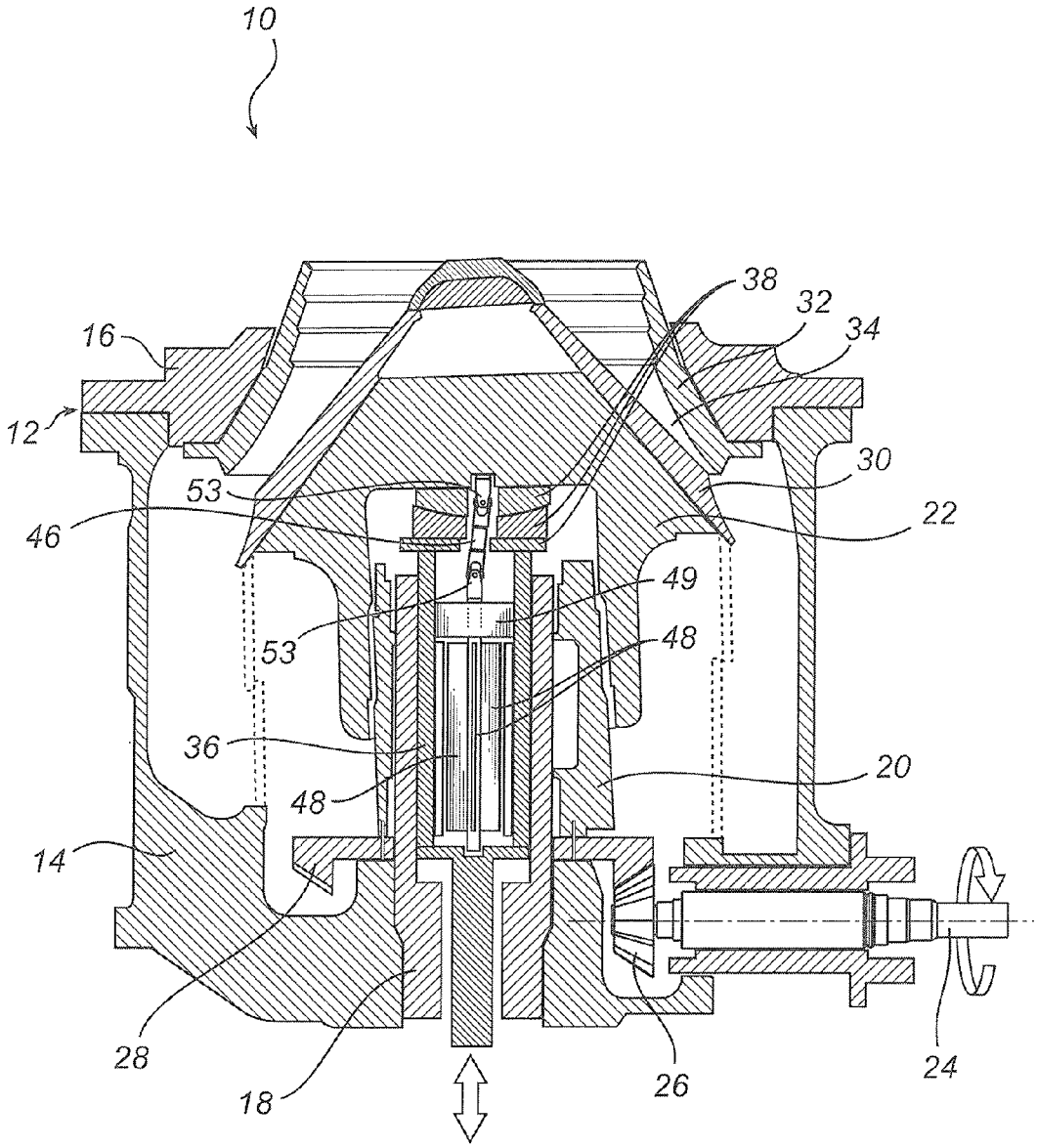
FIG. 1 is a schematic sectional view of an exemplary gyratory crusher provided with a rotation-restricting arrangement.

FIG. 1 illustrates schematically a gyratory crusher 10, which has a frame 12 comprising a frame bottom part 14 and a frame top part 16. A vertical central shaft 18 is fixedly attached to the frame bottom part 14 of the frame 12. An eccentric 20 is rotatably arranged about the central shaft 18. A crushing head 22 is rotatably mounted about the eccentric 20, and thus about the central shaft 18. A drive shaft 24 is arranged to cause the eccentric 20 to rotate about the central shaft 18 by means of a conical gear wheel 26 engaging with a gear rim 28 connected to the eccentric 20. The outer periphery of the eccentric 20 is slightly inclined relative to the vertical plane. Because of the inclination of the outer periphery of the eccentric 20 the crushing head 22 will also be slightly inclined relative to the vertical plane. The crusher 10 shown in FIG. 1 is of the type that is without a top bearing.

A first crushing shell 30 is fixedly mounted on the crushing head 22. A second crushing shell 32 is fixedly mounted on the frame top part 16. Between the two crushing shells 30, 32 a crushing gap 34 is formed, the width of which, in axial section as illustrated in FIG. 1, decreases in the downward direction. When the drive shaft 24 rotates the eccentric 20, during operation of the crusher 10, the crushing head 22 will execute a gyrating movement. A material to be crushed is introduced in the crushing gap 34 and is crushed between the first crushing shell 30 and the second crushing shell 32 as a result of the gyrating movement of the crushing head 22, during which movement the two crushing shells 30, 32 alternately approach and move away from one another. Furthermore, the crushing head 22, and the first crushing shell 30 mounted thereon, will be in rolling engagement with said second crushing shell 32 by way of the material to be crushed. This rolling engagement causes the crushing head 22 to rotate slowly relative to the frame 12 in a direction of rotation that is substantially opposite to the direction of rotation of the eccentric 20.

If no material to be crushed is present in the crushing gap 34, the crushing head 22 will not be in rolling engagement with said second crushing shell 32. Instead, the friction in the bearing mechanism between the eccentric 20 and the crushing head 22 will strive to cause the crushing head 22 to rotate in the same direction and at substantially the same speed as the eccentric 20. Since the speed of rotation of the eccentric 20 is much higher than the typical speed of rotation, during rolling engagement, of the crushing head 22, the crushing head 22 too, unless it is braked in some way, will reach a high speed of rotation when there is no material in the crushing gap 34. Such a significant increase of the rotational speed of the crushing head 22 in a direction of rotation opposite to the direction of rotation during the rolling engagement described above will be referred to below as "spinning". Accordingly, when material is present in the crushing gap 34 and the crushing head 22 is in rolling engagement with the second crushing shell 32, the crushing head 22 rotates slowly in a first direction of rotation, which is opposite to the direction of rotation of the eccentric 20. On the other hand, when no material, or only very little material, is present in the crushing gap 34, there is a risk that the crushing head 22, unless it is braked, quickly starts to rotate in a second direction of rotation, which is the same as the direction of rotation of the eccentric 20, which means that the crushing head 22 is spinning. Spinning is undesirable and may result in increased wear of the crushing shells 30, 32 and of the bearing mechanisms of the crusher 10 provided between the crushing head 22 and the eccentric 20. Spinning may also result in the feed material to be crushed being ejected from the feed opening of the crusher 10.

The crusher 10 is provided with a device that reduces the tendency of the crushing head 22 to spin. Such a device will be described below.

The crushing head 22 is supported on a support piston 36, which is hydraulically vertically adjustable inside the central shaft 18 and rotationally locked to the same. The purpose of the vertical adjustability is, inter alia, to enable any wear of the crushing shells 30, 32 to be compensated for, but also to allow the width of the gap 34 to be varied, in order to produce crushed material of different sizes. A set of thrust bearings 38, which are arranged between the crushing head 22 and the support piston 36, enables tilting of the crushing head 22 during the gyrating movement thereof. The support piston 36 is connected to the crushing head 22 by way of a rotation-restricting arrangement 40, as is shown more clearly in the perspective view in FIG. 2.

Figure 2:
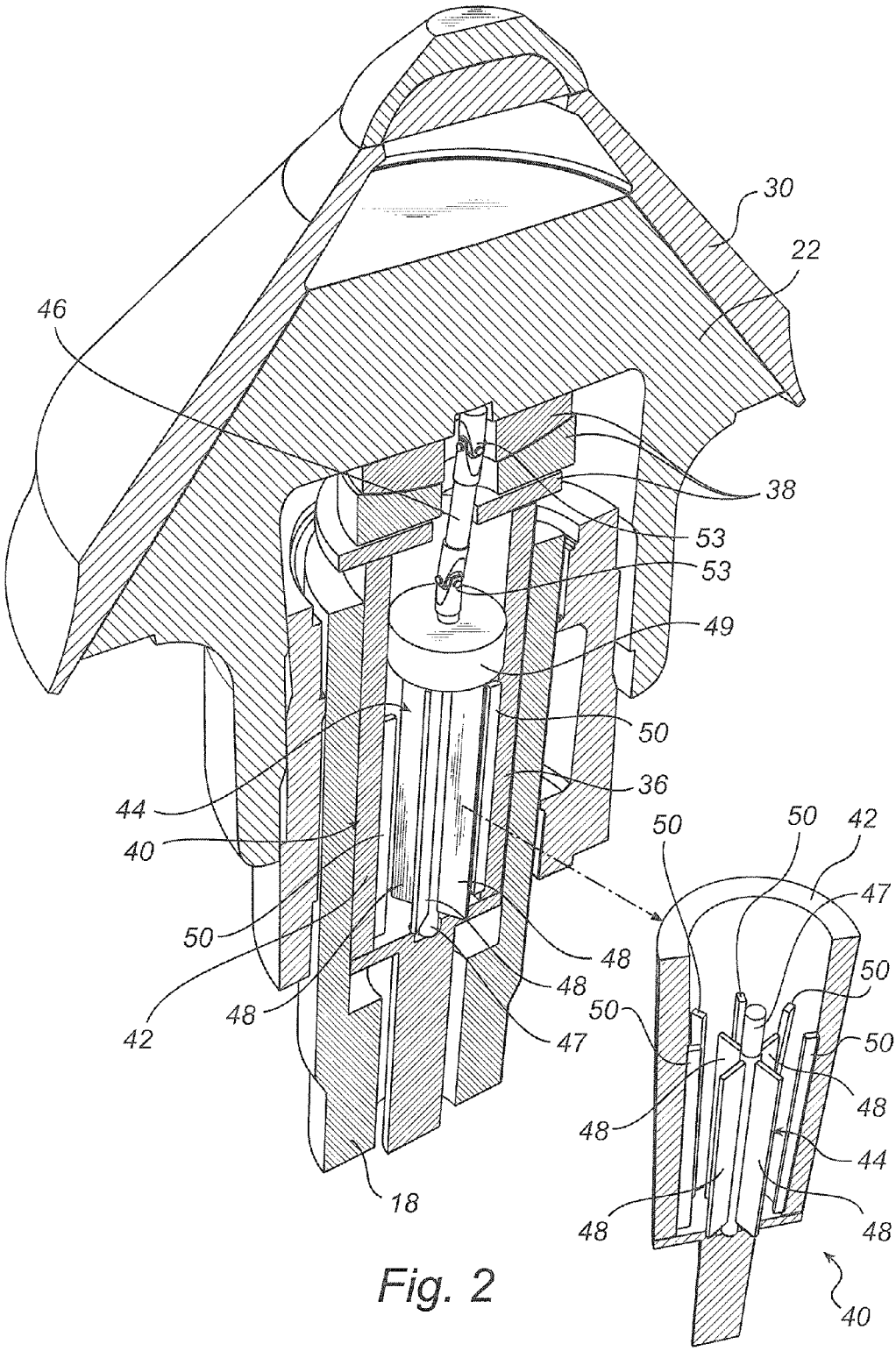
FIG. 2 is a schematic sectional perspective view of the rotation-restricting arrangement in FIG. 1.

FIG. 2 shows the rotation-restricting arrangement 40, which comprises a tank 42 in the form of a substantially cylindrical space formed inside the support piston 36, and a beater 44, which is connected to the crushing head 22 by way of a mechanical slip clutch 49 and a universal joint shaft 46. The tank 42 contains a liquid, suitably in the form of hydraulic oil or lubricating oil, in which the beater 44 is immersed. When rotating the crushing head 22 the universal joint shaft 46, which is connected to the beater shaft 47 of the beater 44, will cause the beater 44 to rotate in the oil, the viscosity of the oil braking the rotation of the beater 44 and, thus, of the crushing head 22 relative to the support piston 36.

The purpose of the mechanical slip clutch 49 is to protect the rotation-restricting arrangement 40 against overload damage which might otherwise occur if the viscosity of the oil in the tank 42 is too high before the oil has reached its working temperature, for example when cold starting the crusher in a cold winter climate. Naturally, torque limiters other than the mechanical slip clutch type can be used.

The universal joint shaft 46 is provided with universal joints 53, which enable the universal joint shaft 46, at the point of attachment to the crushing head 22, to move with the gyrating movement of the crushing head 22. The universal joint shaft 46 can also be provided with splines (not shown) or similar ridges extending along the shaft 46, which allow the length of the universal joint shaft 46 to be adjusted to compensate for any heat expansion and wear of, inter alia, the thrust bearings 38. In the embodiment shown in FIG. 2, this heat expansion and wear compensation is instead achieved by means of a substantial axial play at the lower end surface of the beater shaft 47.

Figure 3:
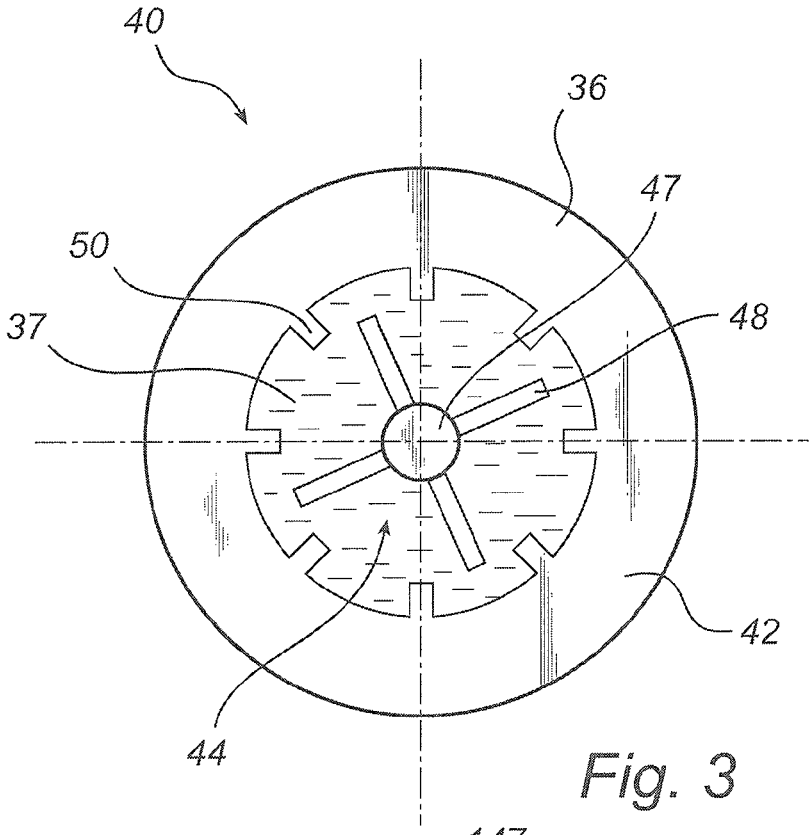
FIG. 3 is a schematic sectional view of an exemplary beater and tank as seen from above.

FIG. 3 shows the tank 42 formed in the support piston 36 and the beater 44 as seen from above. The beater shaft 47 of the beater 44 is provided with projecting members in the form of plate-shaped beater blades 48, which serve to increase the resistance of rotation for the beater 44 in the oil 37 contained in the tank 42. A suitable braking action is obtained if the beater blades 48 have a radial extent, as seen from the beater shaft 47, of at least approximately 2 cm, preferably more than 4 cm. Moreover, for the same reason the beater blades 48 should have an extent, as seen in the longitudinal direction of the beater shaft 47, of at least approximately 10, cm, preferably more than 20 cm. In the shown embodiment, the total area A of the surface projected by the beater blades 48 in the tangential direction of the beater 44 is A=n*r*h, where n is the number of beater blades, r is the radius of the beater blades 48 and h is the extent of the beater blades 48 in the longitudinal direction of the beater shaft 47. The total area A of the beater blades 48 projected in the tangential direction of the beater 44 should be at least approximately 60 $cm^2$.

Furthermore, the inner wall of the tank 42 is provided with protrusions 50, which serve to prevent the oil from creating a swirling motion in the tank 42 during operation, preserving in this way the resistance of the oil. To limit the occurrence of swirling in an efficient manner the protrusions 50 should have an area, as projected in the tangential direction of the beater 44, of at least approximately 10 $cm^2$. The clearance between the beater blades 48 of the beater 44 and the protrusions 50 should be between 1 and 20 mm, more preferred between 2 and 10 mm, to obtain a satisfactory braking action. Moreover, the number of beater blades 48 can be between 2 and 10. The number of protrusions 50 projecting from the tank wall can be between 3 and 20. The number of beater blades 48 can be even or uneven. Irrespectively of the number of beater blades 48, an even or uneven number of protrusions 50 can be used.

During operation of the crusher, the beater 44 will be braked in the oil 37 in the tank 42. The braking action will be essentially the same independent of the direction of rotation of the beater 44. However, the braking action will be largely dependent upon the speed of the beater 44. At low speeds of the beater 44 the braking action will be small, whereas at high speeds a considerable braking action will be obtained. In normal operation of the crusher, such as, when material is fed into the gap 34 shown in FIG. 1, the crushing head 22, and the crushing shell 30 mounted thereon, will be rotating in rolling engagement with the crushing shell 32 at low speed, for example, 0.3 revolutions per second. The crushing head 22 rotates the beater 44 at the same low speed, for example, 0.3 revolutions per second, which is a speed that will generate a very limited braking action in the tank 42. When no material is being introduced into the gap 34, the crushing head 22 will start to spin, or rotate in the same direction as the eccentric 20. The eccentric 20 normally rotates at a speed of approximately 3-8 revolutions per second. As the speed of the crushing head 22 increases as a result of the rotation of the eccentric, for example, at 7.5 revolutions per second, the beater 44 too will rotate faster and faster in the oil 37 in the tank 42. This will significantly increase the braking action exerted on the beater 44 in the tank 42, whereby the beater 44 brakes the rotation of the crushing head 22, thus preventing the crushing head 22 from spinning at the same speed as the eccentric 20. Conveniently the beater 44 and the tank 42 are designed in such a manner that the speed of rotation of the crushing head 22 is reduced by braking to not more than approximately 2 revolutions per second, more preferred not more than 1 revolution per second, when the eccentric 20 is rotating at top speed. In this way, a robust anti-spin function is obtained.

Figure 4:
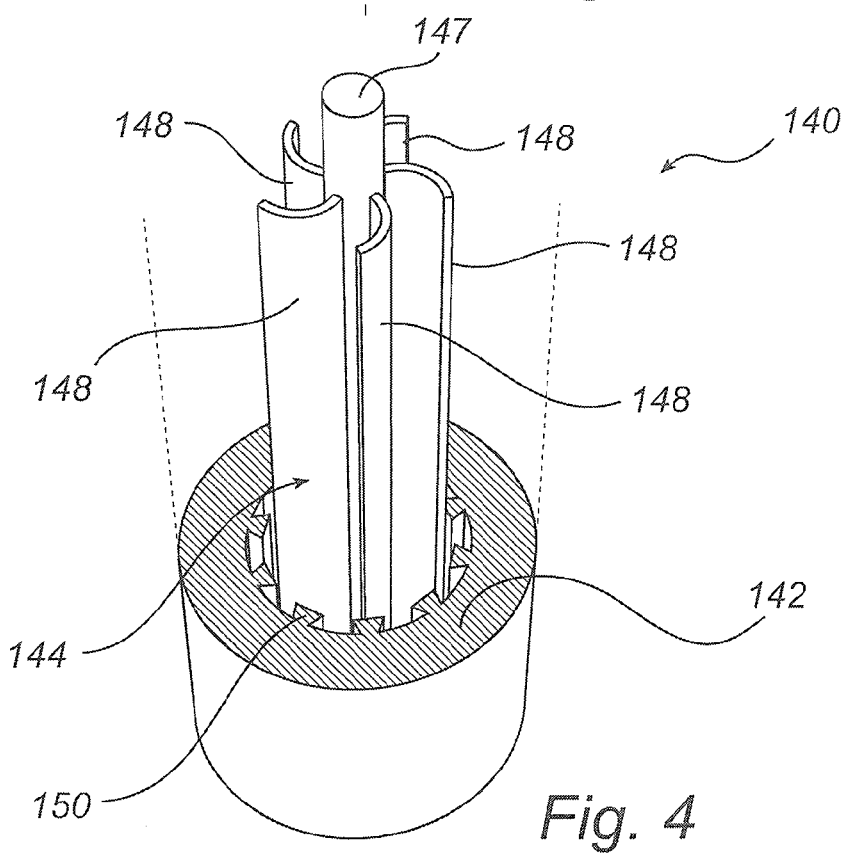
FIG. 4 is a schematic perspective view showing an alternative embodiment of a beater and tank.

FIG. 4 shows an alternative embodiment in which a rotation-restricting arrangement 140 comprises a beater 144, which is adapted to rotate in a tank 142 provided with dovetail protrusions 150 and adapted to contain a liquid, for example hydraulic oil. An upper portion of the wall of the tank 142 has been left out in order to show the beater 144 more clearly. A beater shaft 147 is provided with beater blades 148. The beater blades 148 are curved, seen from above, to provide different rotational resistance depending on the direction of rotation. As a result, the rotational resistance for the beater 144 can be lower in the direction of rotation associated with rolling engagement than in the direction of rotation associated with spinning. It will be appreciated that beater blades can be of various other designs, which provide a greater rotational resistance in one direction of rotation than in the other direction of rotation.

Figure 5A:
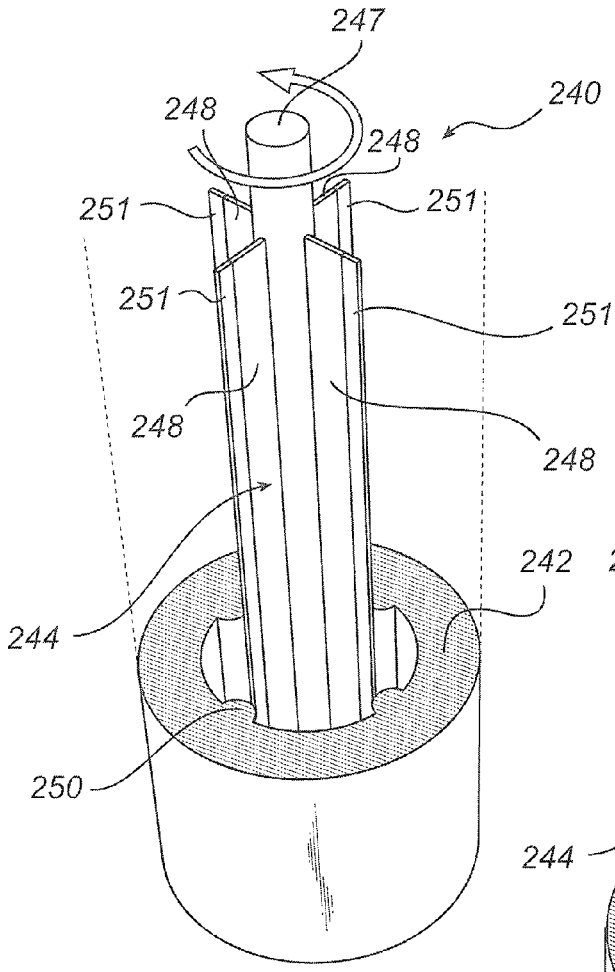
FIGS. 5*a-b* are schematic perspective views showing parts of a further alternative embodiment of a beater and tank, FIG. 5*a* showing the beater at a normal load condition and FIG. 5*b* showing the beater at an overload condition.
Figure 5B:
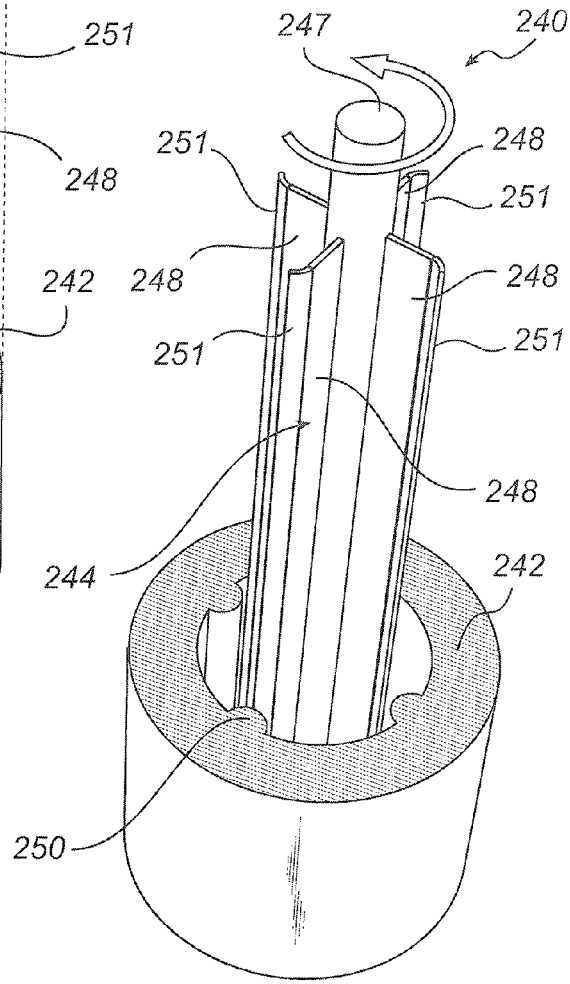

FIGS. 5*a* and 5*b* illustrate a rotation-restricting arrangement 240 which comprises a beater 244, which is adapted to rotate in a tank 242 provided with semi-circular protrusions 250 and adapted to contain a liquid, for example hydraulic oil. An upper portion of the wall of the tank 242 has been left out in order to show the beater 244 more clearly. A beater shaft 247 is provided with beater blades 248. The radially outer portions 251 of the beater blades 248 are made of a resilient material, for example rubber, plastic or spring steel. FIG. 5*a* shows the beater 244 at normal load condition, whereby is meant that the liquid contained in the tank 242 has reached its working temperature and has a relatively low viscosity. FIG. 5*b* shows the beater 244 at an overload condition, whereby is meant that the gyratory crusher has been started at low temperature, at which the temperature of the liquid contained in the tank 242 is low, for example 0° C. or lower, and the viscosity, therefore, is extremely high. Because of the high viscosity in the case shown in FIG. 5*b* the radially outer portions 251 are deflected, which reduces the stress on the beater 244. In this way, operating disturbances caused by damage to the beater 244 due to the high viscosity of the liquid during a cold start are avoided. Accordingly, the deflectable outer portions 251 limit the need for providing a torque limiter at the junction of the beater 244 to the crushing head 22. Once the liquid in the tank 242 has reached the desired working temperature, and thus has a lower viscosity, the outer portions 251 will spring back to the position shown in FIG. 5*a*, thereby providing normal braking action. Alternatively, the beater blades can of course include two or more rigid parts, in which case the deflecting ability is achieved by joining together the rigid parts using springy joints. Furthermore, it will be appreciated that similar results can be obtained if the protrusions 50, 150, 250 projecting from the wall of the tank 42, 142, 242 are bendable, compressible or otherwise arranged to deflect in a springing manner.

It will be appreciated that various modifications of the embodiments described above are conceivable within the scope of the invention, as defined by the appended claims.

Thus, the design of the rotation-restricting arrangement 40 is not limited to that of a rotary beater 44 in a rotationally fixed tank 42. The rotation-restricting arrangement 40 can also have, for example, a rotary tank 42 which is connected to the crushing head and which rotates about a fixed beater 44 connected to the central shaft 18 or to the frame 12, or it can be of any other suitable design. The relative movement of the beater 44 and the tank 42 is not limited to a rotating motion; also linear and other beating motions or combinations of beating motions are conceivable and fall within the scope of the appended claims.

Furthermore, the torque limiter is not limited to a mechanical slip clutch 49, the torque limiter may be of various types.

For example, the torque limiter can be a mechanical or hydraulic slip clutch, or a sacrificial component, which is dimensioned to break at an overload condition to spare the beater.

Preferably, the liquid in the tank 42 is some kind of oil, such as lubricating or hydraulic oil, but may also be any other kind of liquid, such as water.

The beater blades can have a shape other than that of the beater blades 48, 148, 248 shown in the Figures. For example, each beater blade may have the shape of an S or a spiral.

In the embodiments described above, the rotation-restricting arrangement is shown as arranged on a gyratory crusher of the type that is without a top bearing. Naturally, a rotation-restricting arrangement may well be mounted on a gyratory crusher having a top bearing as well as on other types of gyratory crushers.

Although described in connection with preferred embodiments thereof, it will be appreciated by those skilled in the art that additions, deletions, modifications, and substitutions not specifically described may be made without departure from the spirit and scope of the invention as defined in the appended claims.

The invention claimed is:

1. A gyratory crusher, which comprises a crushing head on which a first crushing shell is mounted; a frame on which a second crushing shell is mounted, wherein the second crushing shell defines, together with the first crushing shell, a crushing gap; and a driving device, which is arranged with a rotating eccentric to cause the crushing head to execute a gyratory movement for crushing material that is introduced in the crushing gap, wherein the crushing head is connected to the frame by way of a rotation-restricting arrangement, which comprises a beater arranged to rotate in a tank, the tank being adapted to contain a liquid for braking the rotation of the beater.

2. The crusher according to claim 1, wherein the eccentric is arranged to rotate about a central shaft and the rotation-restricting arrangement is located inside the central shaft.

3. The crusher according to claim 1, wherein the tank has a circular-cylindrical wall, which is provided with at least one protrusion extending towards the beater.

4. The crusher according to claim 1, wherein the beater comprises a beater shaft provided with at least one projecting member, which is to be braked, during rotation of the beater, by a liquid contained in the tank.

5. The crusher according to claim 4, wherein said at least one projecting member of the beater is substantially plate-shaped and extends from the beater shaft in a plane that is substantially parallel to the extent of the beater shaft.

6. The crusher according to claim 4, wherein said at least one projecting member of the beater is of arcuate cross-section, as seen in a plane that is perpendicular to the beater shaft.

7. The crusher according to claim 4, wherein the portion of said at least one projecting member of the beater that is most radially distant from the beater shaft is deflectable.

8. The crusher according to claim 1, wherein the beater is connected to the crushing head by a universal joint shaft, which is provided with at least one universal joint.

9. The crusher according to claim 8, wherein the universal joint shaft is divided into an upper shaft section and a lower shaft section, and said shaft sections are rotationally locked together and axially displaceable relative to each other.

10. The crusher according to claim 1, wherein the rotation-restricting arrangement is adapted to generate, during operation, a braking torque of at least 300 Nm when the crushing head is about to start rotating.

11. The crusher according to claim 1, wherein a speed of rotation relative to the frame of the crushing head, when the crushing head is about to start rotating, is 0 revolutions per second.

12. A crusher according to claim 1, wherein the crushing head is connected to the rotation-restricting arrangement by a torque limiter.

* * * * *